US008232490B2

(12) United States Patent
Bohnen et al.

(10) Patent No.: US 8,232,490 B2
(45) Date of Patent: Jul. 31, 2012

(54) SWITCH ACTIVATED SLIDE LINKAGE

(75) Inventors: Peter Bohnen, Berlin (DE); Erhard Deylitz, Berlin (DE); Pierre Lamoth, Berlin (DE)

(73) Assignee: Siemens Aktiengesellschaft, Munich (DE)

( * ) Notice: Subject to any disclaimer, the term of this patent is extended or adjusted under 35 U.S.C. 154(b) by 248 days.

(21) Appl. No.: 12/671,597

(22) PCT Filed: Jul. 30, 2008

(86) PCT No.: PCT/EP2008/059978

§ 371 (c)(1),
(2), (4) Date: Feb. 1, 2010

(87) PCT Pub. No.: WO2009/019175

PCT Pub. Date: Feb. 12, 2009

(65) Prior Publication Data

US 2011/0186411 A1 Aug. 4, 2011

(30) Foreign Application Priority Data

Aug. 3, 2007 (DE) ..... 10 2007 037 066

(51) Int. Cl.
*H01H 9/20* (2006.01)

(52) U.S. Cl. ..... 200/50.28

(58) Field of Classification Search ..... 200/336, 200/337, 50.01, 50.32
See application file for complete search history.

(56) References Cited

U.S. PATENT DOCUMENTS

| | | | |
|---|---|---|---|
| 4,839,477 | A | 6/1989 | Orosz et al. |
| 4,843,196 | A | 6/1989 | Bissig et al. |
| 4,962,290 | A | 10/1990 | Nelson et al. |
| 5,581,219 | A | 12/1996 | Nozawa et al. |
| 5,661,627 | A | 8/1997 | Liebetruth et al. |
| 5,847,340 | A | 12/1998 | Godesa |
| 5,847,341 | A | 12/1998 | Godesa |
| 5,895,898 | A | 4/1999 | Godesa |
| 6,506,993 | B1 | 1/2003 | Gronemann et al. |

FOREIGN PATENT DOCUMENTS

| | | | |
|---|---|---|---|
| DE | 8331794 | U1 | 4/1984 |
| DE | 29 02 547 | C2 | 5/1991 |
| DE | 4235504 | A1 | 4/1993 |
| DE | 29904223 | U1 | 6/1999 |
| DE | 201 05 889 | U1 | 9/2001 |
| DE | 203 06 435 | U1 | 10/2004 |
| EP | 0060058 | A1 | 9/1982 |

(Continued)

*Primary Examiner* — Vanessa Girardi
(74) *Attorney, Agent, or Firm* — Harness, Dickey & Pierce, P.L.C.

(57) ABSTRACT

One embodiment of the present invention relates to a coupling arrangement for transmission of the rotational movement of a switching shaft of an electrical switch to at least one position signalling device including a mount and including at least one coupling, which is mounted on the mount so that it can rotate, via which the switching shaft is mechanically operatively connected to a device for operation of the at least one position signalling device, when the electrical switch is in the test position or in the operating position. In order to simplify the physical design, an embodiment of the invention provides that the mount be provided with a bayonet contour and that the coupling be provided with at least one bayonet projection, such that the coupling is connected to the mount in the form of a bayonet fitting by means of a plugging-in movement followed by a rotary movement, and that a stop device be arranged on the mount, limiting the movement path of the coupling, which is connected to the mount, to its rotary movement.

16 Claims, 5 Drawing Sheets

FOREIGN PATENT DOCUMENTS

| | | | |
|---|---|---|---|
| EP | 0242538 | A1 | 10/1987 |
| EP | 0 677 904 | A1 | 10/1995 |
| EP | 0 721 647 | B1 | 5/1997 |
| EP | 0789925 | A1 | 8/1997 |
| EP | 0 789 926 | B1 | 5/1998 |
| EP | 0 789 924 | B1 | 6/1998 |
| EP | 1693938 | A1 | 8/2006 |
| FR | 2416575 | A1 | 8/1979 |
| GB | 2015256 | | 9/1979 |
| JP | 11027814 | A | 1/1999 |
| WO | WO 9206484 | A1 | 4/1992 |
| WO | WO 96/13842 | | 5/1996 |

SWITCH ACTIVATED SLIDE LINKAGE

PRIORITY STATEMENT

This application is the national phase under 35 U.S.C. §371 of PCT International Application No. PCT/EP2008/059978 which has an International filing date of Jul. 30, 2008, which designates the United States of America, and which claims priority on German patent application number DE 10 2007 037 066.2 filed Aug. 3, 2007, the entire contents of each of which are hereby incorporated herein by reference.

FIELD

At least one embodiment of the invention generally relates to a coupling arrangement for transmission of the rotational movement of a switching shaft. At least one embodiment of the invention more specifically relates to a coupling arrangement for transmission of the rotational movement of a switching shaft of an electrical switch to at least one position signaling device having a mount and having at least one coupling which is mounted on the mount such that it can rotate and by means of which the switching shaft is mechanically operatively connected to a device for operation of the at least one position signaling device when the electrical switch is in the test or operating position.

BACKGROUND

By way of example, locking assemblies having mechanical position signaling devices (EP 0 789 925 B1) and signaling switch assemblies having position signaling devices in the form of electrical signaling switches are known from low-voltage switching technology. Such locking assemblies and signaling switch assemblies are coupled by way of a coupling arrangement of this generic type to a switching shaft, which is provided with a coupling piece composed of plastic, of an electrical switch in the form of a low-voltage circuit breaker.

The document EP 0 789 925 B1 discloses that the locking assembly described there having mechanical position signaling devices is arranged on a mount. The mount can be attached to an outer wall of a plug-in frame or to an adaptor plate, which is used as a supporting member and is held externally on the electrical switch, depending on the type of installation of the electrical switch (push-in version or permanently installed version).

The known coupling arrangement designed such that the signaling switch assembly, which is arranged in a fixed position on an inner wall of a plug-in frame, the locking assembly which is attached in a fixed position to an outer wall of the plug-in frame or optionally—by way of an irreversible modification of the signaling switch assembly—also both assemblies can be jointly coupled to the switching shaft of the electrical switch which is arranged in the plug-in frame such that it can be moved. In this case, the electrical switch can be moved in a known manner in the plug-in frame from a disconnected position, in which both auxiliary and main contacts are disconnected, via a test position, in which only the auxiliary contacts are connected, to an operating position, in which both the auxiliary and the main contacts are connected. The electrical switch can be switched, with the switching shaft being rotated, in the operating position, in the test position and in the disconnected position.

The known coupling arrangement uses two couplings in the operating position and in the test position to transmit the rotational movement of the switching shaft to the signaling switch assembly during switching of the electrical switch, and can be irreversibly changed by a modification such that, in the operating position, it additionally passes on the rotational movement of the switching shaft to the locking assembly, as well. This known coupling arrangement comprises a large number of individual parts and involves a correspondingly large amount of assembly effort.

SUMMARY

Against the background of a coupling arrangement, at least one embodiment of the invention simplifies the design configuration of the coupling arrangement.

According to at least one embodiment of the invention, a mount has a bayonet contour and the coupling has at least one bayonet projection, such that the coupling is connected to the mount via an insertion movement and a subsequent rotational movement in the form of a bayonet fitting. Further, a stop is arranged on the mount and limits the movement path of the coupling which is connected to the mount to its rotational movement. The coupling is held captive on the mount in a simple manner by the stop.

In one advantageous design refinement of at least one embodiment of the novel coupling arrangement, the mount is formed from a metal base sheet and an intermediate metal sheet which is attached to the metal base sheet, wherein the metal base sheet has a first aperture, and the intermediate metal sheet has a second aperture, which is aligned with the first aperture and is provided with at least one output bulge, wherein the metal base sheet and the intermediate metal sheet rest flat on one another such that the apertures form the bayonet contour for holding the at least one bayonet projection which is formed on the coupling.

As a first device for operation, a further advantageous refinement of at least one embodiment provides a slide which is guided on the mount, is provided with operating members for operation of position signaling devices in the form of electrical signaling switches and has at least one control tab which projects into the movement path of the at least one coupling, wherein the movement path of the at least one coupling can be limited in a simple manner by the slide forming the stop. For positively controlled return of the coupling while the electrical switch is being switched off, it is advantageous for the coupling to have a stop surface which is designed such that it overlaps the at least one control tab over the entire movement path of the slide.

The slide can advantageously be held by a return spring in a predetermined basic position which is bounded by a first stop. It can then be moved to a limit position, which is bounded by a second stop, only under the force of the rotating switching shaft and against the force of the return spring.

In order to compensate for any overtravel of the switching shaft during the switching-on process, it is advantageous for the slide to comprise two partial slides which are coupled to one another and can be moved with respect to one another by way of a spring.

An operating shaft of a mechanical position signaling device of a locking assembly can be provided as a second device for operation, and has an end piece which engages in a coupling slot in the coupling such that it cannot rotate.

In order to transmit the rotational movement of a switching shaft of an electrical switch to at least one position signaling device, the novel coupling arrangement can, for example, be attached to an inner face of a plug-in frame for the electrical switch (push-in version) or to an adaptor plate which is held on the electrical switch (permanently installed version), depending on the type of installation of the electrical switch.

BRIEF DESCRIPTION OF THE DRAWINGS

The invention will be explained in more detail in the following text with reference, in order to assist understanding, to one example embodiment, which does not restrict the scope of protection of the invention and is illustrated in the drawings, in which.

DETAILED DESCRIPTION OF THE EXAMPLE EMBODIMENTS

Figure 1:
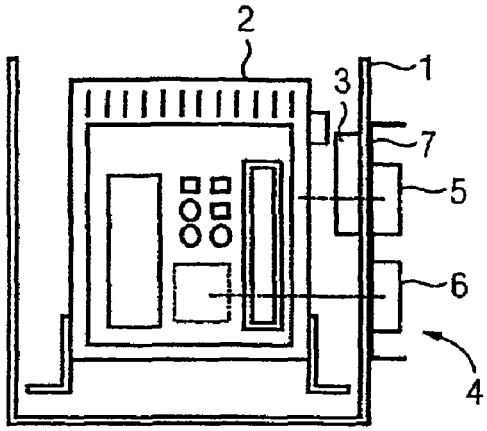
Conventional Art FIG 1
FIG. 1 shows a schematic illustration of an arrangement, which is known from practical use, comprising a plug-in frame and an electrical switch, which can be moved in the plug-in frame and is in the form of a low-voltage circuit breaker, in which arrangement the plug-in frame is provided with a signaling switch assembly and a locking assembly.

FIG. 1 schematically illustrates an arrangement, which is known from practical use, comprising a plug-in frame 1 and an electrical switch 2, which can be moved in the plug-in frame and is in the form of a circuit breaker, in which arrangement the plug-in frame 1 is provided with a signaling switch assembly 3 and a locking assembly 4. In this case, the locking assembly 4 comprises a mounting plate 7 which is fitted with a position signaling device 5 and an evaluation appliance 6. A plurality of electrical switches can be interlocked by means of such locking assemblies and transmission members connecting them in the form of cable runs, as is known by way of example from the document EP 0 789 925 B1.

The purpose of the position signaling device 5 is to emit a mechanical signal which is dependent on the switch position of a switching shaft in the relevant electrical switch.

Figure 2:
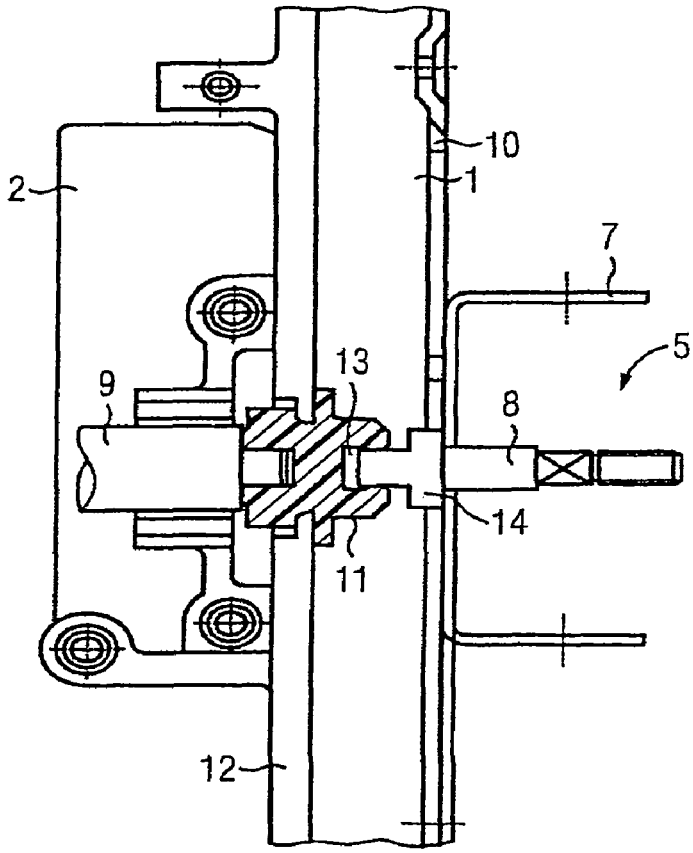
FIG 2 Conventional Art
FIG. 2 shows a detail of an arrangement as shown in FIG. 1, in which only one position signaling device for the locking assembly is coupled by way of a coupling piece composed of plastic to a switching shaft of the electrical switch.

As shown in FIG. 2, for this purpose, the position signaling device 5 has a means for operation in the form of an operating shaft 8, which is coupled to the switching shaft 9 of the electrical switch 2. In this case, the mounting plate 7 of the locking assembly is attached externally to the right-hand side wall 10 of the plug-in frame 1. A shaft coupling in the form of a coupling piece 11, which is composed of plastic and is mounted such that it can rotate in one side wall 12 of the electrical switch 2, in this case connects the switching shaft 9 of the electrical switch 2 only to the operating shaft 8 of the position signaling device 5, but not to the signaling switch assembly.

The coupling piece 11 has a coupling slot 13 into which an appropriately shaped end piece 14 of the operating shaft 8 can be inserted. This allows a connection to be made between the switching shaft 9 and the operating shaft 8 both by movement and by plugging in.

Figure 3:
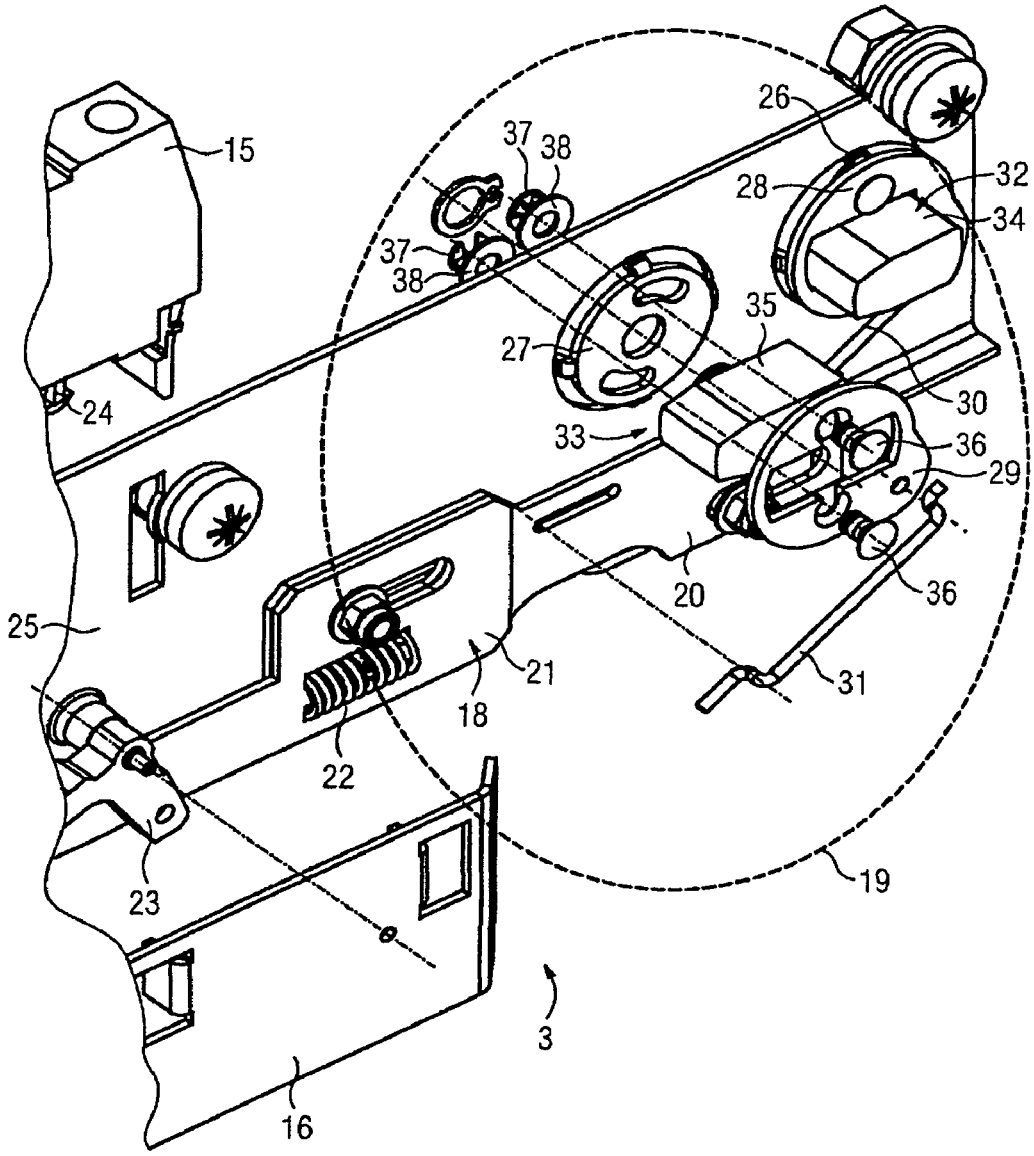
Conventional Art FIG 3
FIG. 3 shows a further detail of an arrangement as shown in FIG. 1, in which only one position signaling device of the signaling switch assembly or optionally, additionally, the position signaling device of the locking assembly, is coupled to the switching shaft of the electrical switch.

FIG. 3 shows a signaling switch assembly 3, which is known from practical use, comprising position signaling devices 15 in the form of electrical signaling switches (only one of the signaling switches can be seen in FIG. 3), a metal holding sheet 16, to which the signaling switches are latched, a means for operation of the signaling switches in the form of a slide 18, and a coupling arrangement 19 for transmission of the rotational movement of the switching shaft of the electrical switch to the signaling switches. In this case, the slide 18 comprises two partial slides 20 and 21, which are coupled by a spring 22, wherein the partial slide 21 facing the signaling switches is provided with operating members 23 which can pivot and act on operating members 24 of the signaling switches.

The known coupling arrangement 19, which is attached to the inner face of the right-hand side wall 10, as shown in FIG. 2, of the plug-in frame 1, has a mount 25 in the form of a metal base sheet which is provided with two stamped-in areas 26, 27, as well as two metal control sheets 28, 29, two control wires 30, 31 and a first coupling 32 for the test position, and a second coupling 33 for the operating position of the electrical switch in the plug-in frame.

That end of the switching shaft which is provided with the coupling piece has a coupling slot, which engages over a coupling pin 34 or 35 on the respective corresponding coupling 32 or 33 in the test position and in the operating position, respectively, as a result of which the respective coupling 32 or 33 is rotated by rotation of the switching shaft during switching on. This now acts via the respective metal control sheet 28 or 29 and the respective control wire 30 or 31 on the slide 18, which is thus moved.

When the signaling switch assembly 3, which is screwed internally to the right-hand side wall, is intended to be operated together with the locking assembly, which is screwed externally to this side wall, in order to lock the switch in its operating position, it is necessary to modify the mount 25 (the metal base sheet) irreversibly. For this purpose, the stamped-in area 27 which is associated with the operating position must be removed.

The metal control sheet 29 is screwed by way of screws which must be kept available (that are not shown) to the operating shaft 8, which is shown in FIG. 2, of the position signaling device 5, which is provided with two threaded holes, which are not illustrated in any more detail, or can be replaced by an operating shaft, which is provided with the two threaded holes. The coupling 33 for the operating position as well as associated pins 36 (which are replaced by the screws that must be kept available), locking disks 37 and washers 38 are not required in this case. The control wire 31 is still used and acts as a push rod for transmission of the rotational movement of the metal control sheet 29 to the slide 18, in order to move the latter.

The coupling arrangement according to an embodiment of the invention will be described in the following text with reference to FIGS. 4 to 11.

Figure 4:
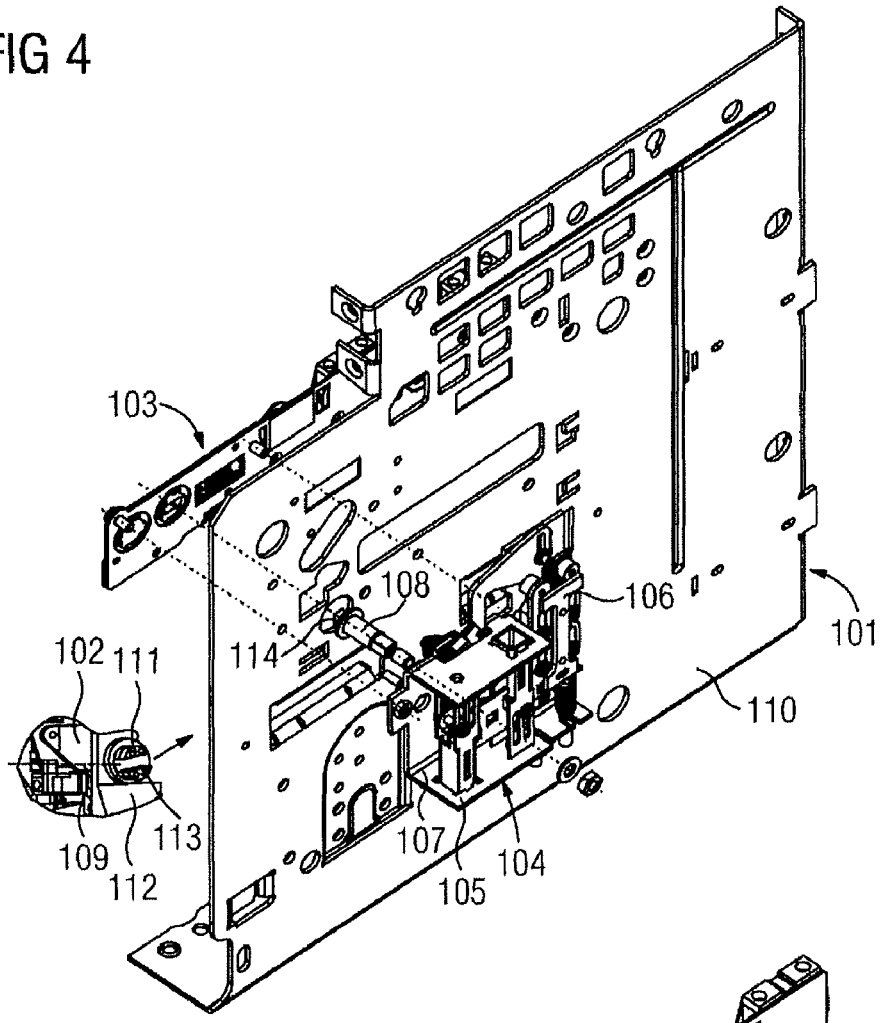
FIG. 4 shows a further arrangement, comprising a plug-in frame and an electrical switch, in which the plug-in frame is provided with a signaling switch assembly and a locking assembly, and in which the rotational movement of a switching shaft of the electrical switch is transmitted to position signaling devices of both assemblies by means of a coupling arrangement according to an embodiment of the invention.

FIG. 4 shows—in the same way FIG. 1 has already done—an arrangement comprising a plug-in frame 101 and an electrical switch 102, which can be moved in the plug-in frame and is in the form of a circuit breaker, but only a small detail of which is illustrated here. The plug-in frame 1 is provided with a signaling switch assembly 103 and a locking assembly 104 (cf. also FIG. 5). The locking assembly 104 in this case comprises a mounting plate 107 which is fitted with a position signaling device 105 and an evaluation appliance 106.

The position signaling device 105 has a device for operation in the form of an operating shaft 108 which, in a manner which is still to be described, is coupled by means of the coupling arrangement according to an embodiment of the invention to the switching shaft 109 of the electrical switch 102. The mounting plate 107 of the locking assembly 104 is attached externally to the right-hand side wall 110 of the plug-in frame 101. The free end of the switching shaft 109 is provided with a coupling piece 111 which is composed of plastic, is mounted in a side wall 112 of the electrical switch 102 such that it can rotate, and has a coupling slot 113.

FIGS. 6 to 9 show the signaling switch assembly 103, which comprises position signaling devices 115 in the form of electrical signaling switches, a metal holding sheet 116 to which the signaling switches are latched, a device for operation of the signaling switches in the form of a slide 118, and a coupling arrangement 119 for transmission of the rotational movement of the switching shaft of the electrical switch to the signaling switches. In this case, the slide 118 comprises two partial slides 120 and 121, which are coupled by a spring 122, wherein the slide is provided with operating elements 123 which can pivot and act on operating members 124 of the signaling switches.

The coupling arrangement 119, which is attached to the inner face of the right-hand side wall 110, as shown in FIG. 4, of the plug-in frame 101, has a mount 125 as well as a first coupling 132 for the test position and a second coupling 133 for the operating position of the electrical switch in the plug-in frame.

That end of the switching shaft which is provided with the coupling piece 111 (cf. FIG. 9) has a coupling slot 113 which engages over respective coupling pins 134 and 135 of the respective corresponding coupling 132 or 133 in the test position and in the operating position, respectively, such that the respective coupling 132 or 133 is rotated by rotation of the switching shaft during switching on.

Figure 6:
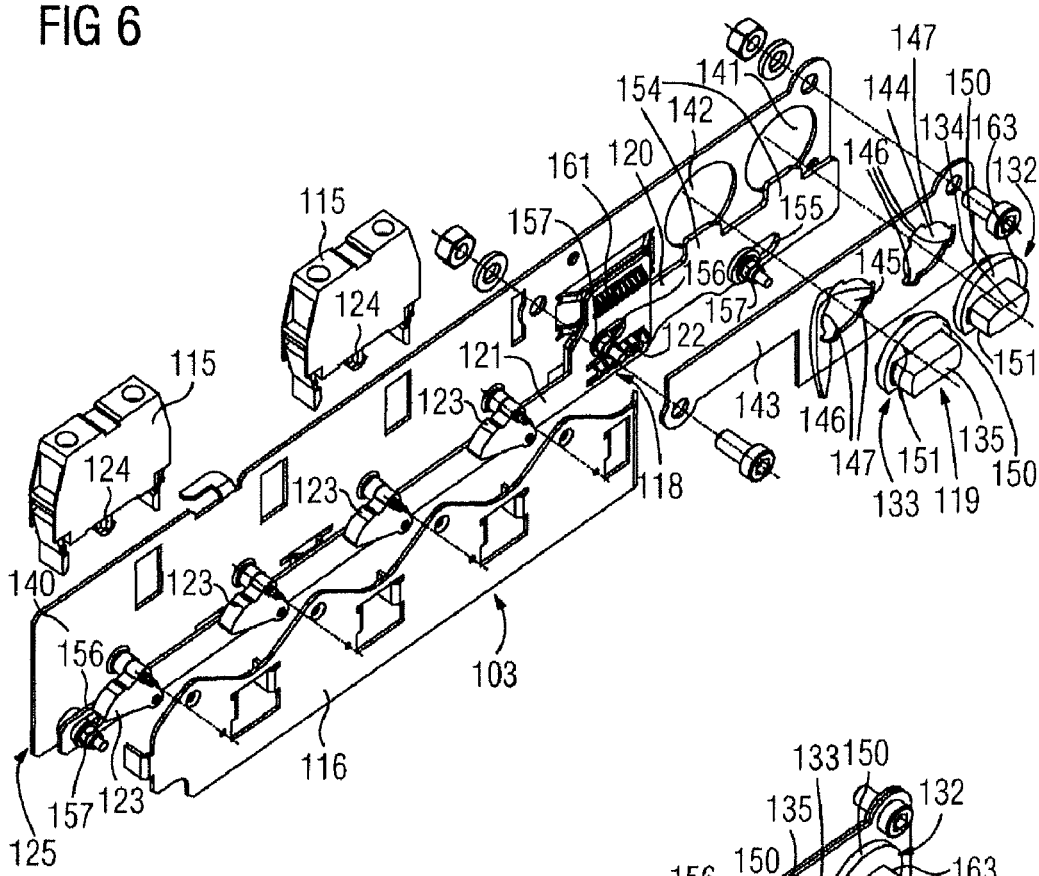
Figure 7:
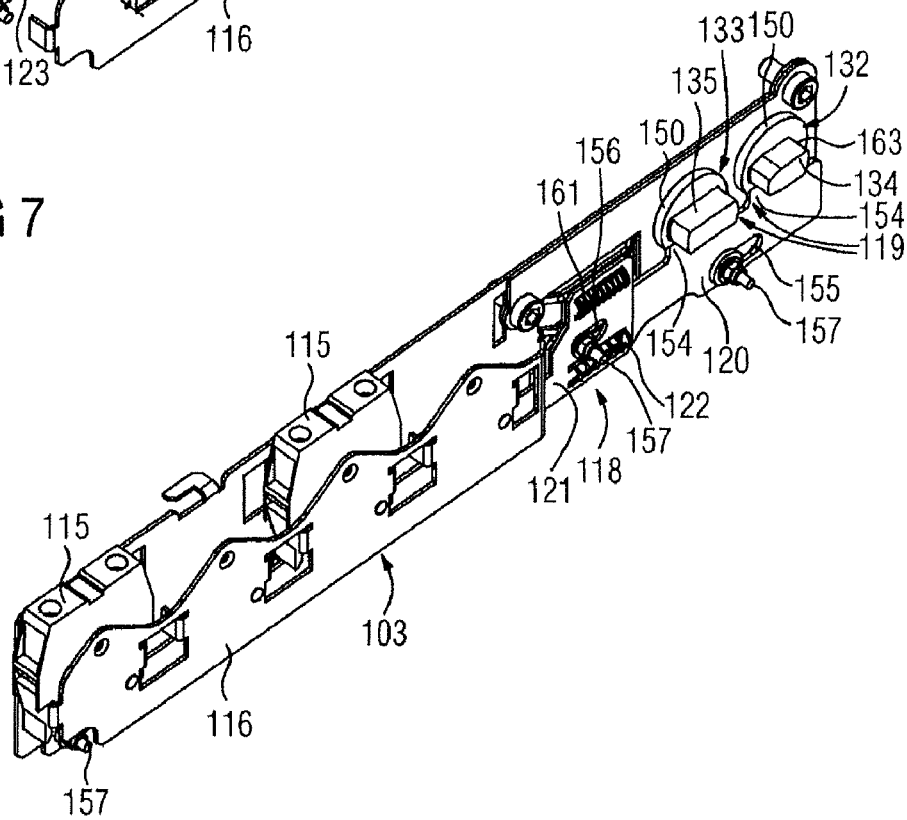
Figure 8:
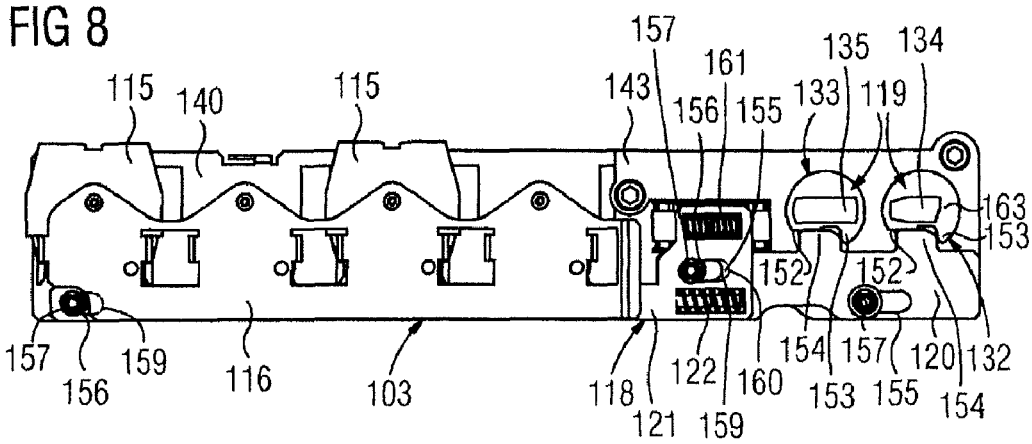
Figure 9:
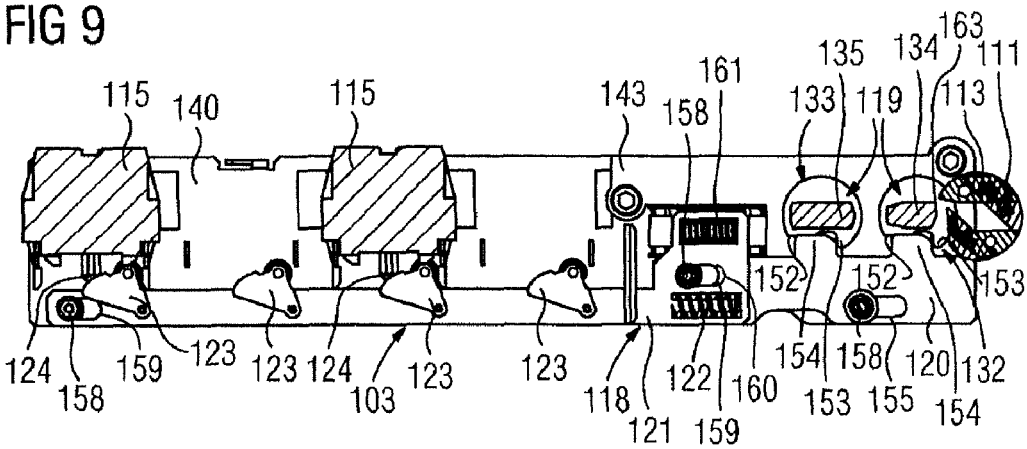
Figure 10:
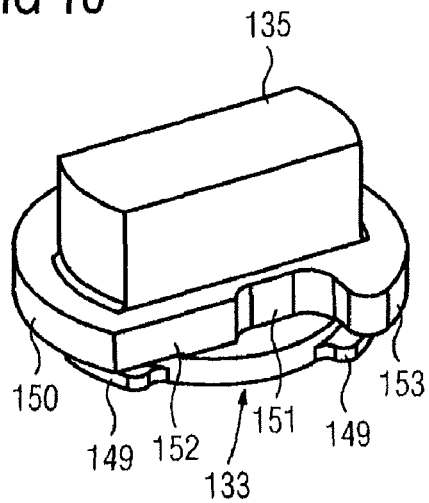
Figure 11:
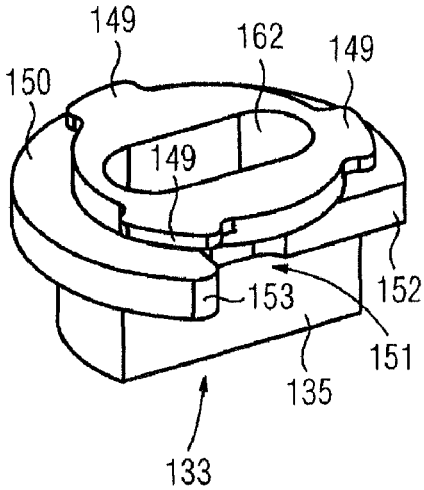

As shown in FIG. 6, the mount 125 comprises a metal base sheet 140 which is provided with first apertures 141, 142, and an intermediate metal sheet 143 which is held on the metal base sheet and is provided with second apertures 144, 145 which are aligned with the first apertures. The second apertures 144, 145 each have three output bulges 146. The intermediate metal sheet 143 rests flat on the metal base sheet 140 and therefore forms a type of keyhole with tabs 147.

Figure 5:
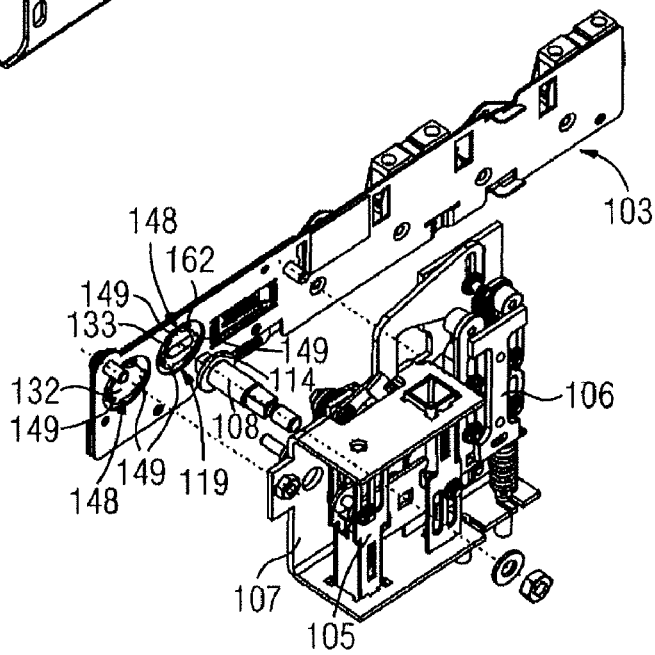
FIGS. 5 to 11 show various views and details of the arrangement shown in FIG. 4.

As shown in FIG. 5, the first apertures 141, 142 together with the second apertures 144, 145 form a bayonet contour 148. The couplings 132 and 133 are each provided with three bayonet projections 149, which are matched to the shape of the output bulges 146 (cf. FIG. 6) and pass through them when the couplings 132, 133 are inserted. During the subsequent rotation of the couplings 132, 133, the bayonet projections 149 engage behind the tabs 147.

The couplings 132, 133 are inserted into the mount 125 with the couplings in a position which is not subsequently for operation. The couplings have a collar 150 which rests on the intermediate metal sheet 143 and each have a cutout 151 (cf. FIGS. 10 and 11) on the plane of the collar 150, which cutout 151 forms a contact surface 152 and a control tooth 153. The contact surface 152 and the control tooth 153 are used for meshing with a respective control tab 154 on the partial slide 120. The slide 118 therefore forms a stop means which limits the movement path of the coupling which is connected to the mount. For this purpose, the first of the partial slides 120 is guided on the metal base sheet, on the plane of the collar 150 of the couplings.

The two partial slides 120, 121, which are coupled to one another by means of the spring 122, have two respective elongated holes 155 and 156 in order to guide them on the metal base sheet, through which elongated holes screw connections 157 pass. In this case, the elongated holes 155 in the first partial slide 120, which is provided with the control tabs 154, are longer than the elongated holes 156 in the second partial slide 121. The elongated holes 155, 156, which are formed in the mutually facing ends of the partial slides 120, 121, are in this case arranged such that they are aligned with one another, with a common screw connection 157 passing through them. This ensures that the two partial slides 120, 121 can move with respect to one another. This allows the first partial slide 120 to still be moved somewhat even when the second partial slide 121 has already reached its limit position—where the operating elements 123 operate the operating members 124. This ensures that the operating members 124 are still operated during the overtravel of the switching shaft, which is required for switching on.

The left-hand ends of the elongated holes 155 and 156 each form a first end stop 158 for the slide 118. Furthermore, the right-hand ends of the elongated holes 156 form an intermediate stop 159, while the right-hand ends of the elongated holes 155 form a second end stop 160. The slide 118 is held in a basic position, which is bounded by the first stops 158, by means of a return spring 161 which is supported between the metal base sheet 140 and the second partial slide 121. Under the force of the rotating switching shaft, it can first of all be moved only against the force of the return spring 161 to an intermediate position, which is bounded by the intermediate stops 159, and can then be moved by movement of the partial slides 120, 121 with respect to one another to a limit position, against the additional force of the spring 122. During the transition from the intermediate position to the limit position, only the first partial slide 120 is therefore now still in motion, but not the second partial slide 121.

The contact surfaces 152 on the couplings 132, 133 prevent undesirable rotation of the couplings 132, 133 in the counterclockwise direction. For this purpose, the contact surfaces 152 are designed to be sufficiently long that they ensure a continuous overlap of the contact surfaces 152 and control tabs 154 throughout the entire movement path of the partial slide 120, thus ensuring that the couplings 132, 133 are reset under positive control when the electrical switch is being switched off.

The couplings 132, 133 are connected in a captive manner to the intermediate metal sheet 143 by their proximity to the slide 118 and the maximum possible rotation angle of the couplings, and the maximum possible movement distance of the first partial slide 120.

As shown in FIGS. 4 and 5, the joint operation of the signaling switch assembly 103, which is screwed on the inside of the right-hand side wall, together with the locking assembly 104, which is screwed to this side wall on the outside, is ensured in a simple manner by the novel coupling arrangement 119. For this purpose, on the side facing the plug-in frame, the coupling 133 has a coupling slot 162 in which an appropriately shaped end piece 114 of the operating shaft 108 of the position signaling device 105 of the locking assembly engages such that it cannot rotate. For this purpose, by way of example, the coupling slot 114 is in the form of an elongated hole or a quadrilateral hole.

In comparison to the coupling arrangement known from practical use (FIGS. 1 to 3), the design of the coupling arrangement according to an embodiment of the invention is considerably simpler and it can therefore be assembled more easily, since, for example, it is composed of considerably fewer components. It is also distinguished by being more robust, and does not require irreversible modification for optional additional coupling of the operating shaft 108 of the locking assembly 104.

The novel coupling arrangement can, of course, be used for the various known types of installation of an electrical switch—that is to say not only for the plug-in version as shown in the figures, but, for example, also for a permanently installed version. The novel coupling arrangement for the permanently installed version of an electrical switch is therefore attached to an adaptor plate, which is held on the electrical switch.

Different sizes of electrical switches often differ in the distance between the free end of the switching shaft, which is provided with the coupling piece, and the plug-in frame 101 or the adaptor plate. The novel coupling arrangement can be matched to these different sizes by providing a set of (at least two) couplings provided with coupling pins of different length, from which the appropriate one is selected and is connected to the mount by a simple insertion movement, followed by a rotational movement, in the form of a bayonet fitting.

As FIGS. 4 to 11 show, the coupling for the operating position is not the same as the coupling for the test position. The coupling pin for the coupling for the test position is provided with an orifice 163 which allows switching in the disconnected position, since the coupling pin 134 does not project into the rotation path of the coupling piece 111, which is plugged onto the switching shaft 109 of the electrical switch 102 when in the disconnected position.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

The invention claimed is:

1. A coupling arrangement for transmission of rotational movement of a switching shaft of an electrical switch to at least one position signaling device, the coupling arrangement comprising:

a mount including a bayonet contour;

at least one coupling, mounted to be rotatable on the mount and by which the switching shaft is mechanically operatively connected to a device for operation of the at least one position signaling device when the electrical switch is in a test or operating position, the at least one coupling including at least one bayonet projection, the at least one coupling being connected to the mount via an insertion movement and a subsequent rotational movement in the form of a bayonet fitting;

a stop, arranged on the mount, to limit a movement path of the at least one coupling connected to the mount, to its rotational movement; and an operating shaft of a mechanical position signaling device of a locking assembly configured as a second device for operation, and includes an end piece which engages in a coupling slot in the at least one coupling such that the at least one coupling cannot rotate.

2. A plug-in frame for an electrical switch comprising:

a coupling arrangement for transmission of a rotational movement of a switching shaft of the electrical switch to at least one position signaling device, the coupling arrangement being designed as claimed in claim 1 and being attached to an inner face of the plug-in frame.

3. An electrical switch comprising:

a coupling arrangement for transmission of the rotational movement of a switching shaft of the electrical switch to at least one position signaling device, the coupling arrangement being designed as claimed in claim 2 and being attached to an adaptor plate, which is attached to the electrical switch.

4. A coupling arrangement for transmission of rotational movement of a switching shaft of an electrical switch to at least one position signaling device, the coupling arrangement comprising:

a mount including a bayonet contour, the mount being formed from a metal base sheet and an intermediate metal sheet which is attached to the metal base sheet, the metal base sheet including a first aperture and the intermediate metal sheet includes a second aperture, aligned with the first aperture, and provided with at least one output bulge;

at least one coupling, mounted to be rotatable on the mount and by which the switching shaft is mechanically operatively connected to a device for operation of the at least one position signaling device when the electrical switch is in a test or operating position, the at least one coupling including at least one bayonet projection, the at least one coupling being connected to the mount via an insertion movement and a subsequent rotational movement in the form of a bayonet fitting, the metal base sheet and the intermediate metal sheet rest flat on one another such that the first and second apertures form the bayonet contour for holding the at least one bayonet projection formed on the at least one coupling; and a stop, arranged on the mount, to limit a movement path of the at least one coupling connected to the mount, to its rotational movement.

5. The coupling arrangement as claimed in claim 4, an operating shaft of a mechanical position signaling device of a locking assembly is provided as a second device for operation, and includes an end piece which engages in a coupling slot in the at least one coupling such that the at least one coupling cannot rotate.

6. A plug-in frame for an electrical switch comprising:

a coupling arrangement for transmission of a rotational movement of a switching shaft of the electrical switch to at least one position signaling device, the coupling arrangement being designed as claimed in claim 1 and being attached to an inner face of the plug-in frame.

7. An electrical switch comprising:

a coupling arrangement for transmission of the rotational movement of a switching shaft of the electrical switch to at least one position signaling device, the coupling arrangement being designed as claimed in claim 1 and being attached to an adaptor plate, which is attached to the electrical switch.

8. The coupling arrangement as claimed in claim 4, further comprising a slide, provided as the device for operation, the slide being guided on the mount and being provided with operating members for operation of the position signaling devices in the form of electrical signaling switches and including at least one control tab which projects into the movement path of the at least one coupling.

9. The coupling arrangement as claimed in claim 8, wherein the slide is held by way of a return spring in a basic position which is bounded by a first stop, and can be moved to a limit position, which is bounded by a second stop, under a force of the rotating switching shaft and against a force of the return spring.

10. The coupling arrangement as claimed in claim 8, wherein the slide comprises two partial slides which are coupled to one another and which are movable with respect to one another by way of a spring.

11. The coupling arrangement as claimed in claim 8, wherein the slide forms the stop for limiting the movement path of the coupling.

12. The coupling arrangement as claimed in claim 11, wherein the slide is held by way of a return spring in a basic position which is bounded by a first stop, and can be moved to a limit position, which is bounded by a second stop, under a force of the rotating switching shaft and against a force of the return spring.

13. The coupling arrangement as claimed in claim 11, wherein the slide comprises two partial slides which are coupled to one another and which are movable with respect to one another by way of a spring.

14. The coupling arrangement as claimed in claim 11, wherein the coupling includes a stop surface which is designed for positively controlled return of the at least one coupling while the electrical switch is being switched off, such that the stop surface overlaps the at least one control tab over the entire movement path of the slide.

15. The coupling arrangement as claimed in claim 14, wherein the slide is held by way of a return spring in a basic position which is bounded by a first stop, and can be moved to a limit position, which is bounded by a second stop, under a force of the rotating switching shaft and against a force of the return spring.

16. The coupling arrangement as claimed in claim 14, wherein the slide comprises two partial slides which are coupled to one another and which are movable with respect to one another by way of a spring.

* * * * *